US011478397B1

(12) United States Patent
Gonglach

(10) Patent No.: US 11,478,397 B1
(45) Date of Patent: Oct. 25, 2022

(54) VIBRATING ROLLER

(71) Applicant: Rolling Forward, LLC, Boulder, CO (US)

(72) Inventor: Mark Steven Gonglach, Boulder, CO (US)

(73) Assignee: Rolling Forward, LLC, Boulder, CO (US)

( * ) Notice: Subject to any disclaimer, the term of this patent is extended or adjusted under 35 U.S.C. 154(b) by 183 days.

(21) Appl. No.: 16/902,304

(22) Filed: Jun. 16, 2020

(51) Int. Cl.
*A61H 15/00* (2006.01)

(52) U.S. Cl.
CPC . *A61H 15/0085* (2013.01); *A61H 2015/0021* (2013.01); *A61H 2015/0071* (2013.01); *A61H 2201/169* (2013.01); *A61H 2201/5005* (2013.01); *A61H 2201/5025* (2013.01); *A61H 2201/5043* (2013.01); *A61H 2201/5097* (2013.01)

(58) Field of Classification Search
CPC ..... A61H 15/00; A61H 15/0078; A61H 15/0085; A61H 15/0092; A61H 15/02; A61H 2015/0007; A61H 2015/0014; A61H 2015/0021; A61H 2015/0028; A61H 2015/0035; A61H 2015/0042; A61H 2015/005; A61H 2015/0057; A61H 2015/0064; A61H 2015/0071; A61H 23/02; A61H 23/0254; A61H 23/0263; A61H 2201/169; A61H 2201/5005; A61H 2201/5025; A61H 2201/5043; A61H 2201/5097; F16D 1/10; F16D 2001/103
USPC ..... 248/297.21, 298.1
See application file for complete search history.

(56) References Cited

U.S. PATENT DOCUMENTS

| | | | | |
|---|---|---|---|---|
| 2,461,413 | A | 7/1946 | Dirand | |
| 2,675,800 | A * | 4/1954 | Voorhees, V | A61H 23/0263 601/72 |
| 2,939,455 | A | 6/1960 | Arnold | |
| 2,943,621 | A * | 7/1960 | Phillips | A61H 23/0218 5/915 |
| 3,970,078 | A | 7/1976 | Rogers, Jr. | |
| 4,136,867 | A | 1/1979 | Wilkin | |
| 4,699,126 | A | 10/1987 | Lancaster | |
| 5,554,102 | A | 9/1996 | Chiou | |
| 5,637,065 | A | 6/1997 | Chang | |
| 5,830,161 | A | 11/1998 | Cosmano | |
| 6,647,572 | B2 | 11/2003 | Lee | |
| 7,137,926 | B2 | 11/2006 | Barrows | |
| 7,156,817 | B1 | 1/2007 | Cassidy Phillips | |
| 7,223,251 | B1 | 5/2007 | Cassidy Phillips | |
| 7,285,101 | B2 | 10/2007 | Tumey | |

(Continued)

*Primary Examiner* — Colin W Stuart
*Assistant Examiner* — Douglas Y Sul
(74) *Attorney, Agent, or Firm* — Thomas J. Lavan

(57) ABSTRACT

A vibration device is provided. The vibration device includes one or more of an aluminum tube of cylindrical disposition, with exterior and interior surfaces, a foam roller, coupled to and disposed around the exterior surface of the tube and of a similar length as the tube, a pair of end caps, coupled to each end of one or more of the tube and foam roller, a power source, disposed within the tube, and a motor, coupled to the interior surface and centrally disposed within the tube. The motor is configured to impart vibration to the tube and the foam roller in response to the motor energized by the power source.

20 Claims, 12 Drawing Sheets

*Vibrating Roller Exploded View*

(56) References Cited

U.S. PATENT DOCUMENTS

| | | | | |
|---|---|---|---|---|
| 8,556,837 | B1 * | 10/2013 | Poirier | A61H 15/00 601/46 |
| 9,005,146 | B2 | 4/2015 | Cassidy Phillips | |
| 9,132,055 | B1 * | 9/2015 | Wallace | A61H 7/00 |
| 9,968,513 | B1 * | 5/2018 | Marton | A61H 23/0263 |
| 2004/0267173 | A1 | 12/2004 | Mangano | |
| 2008/0018167 | A1 | 1/2008 | Fuji | |
| 2008/0070210 | A1 | 3/2008 | Hitzmann | |
| 2008/0255477 | A1 | 10/2008 | Woggon et al. | |
| 2010/0113992 | A1 | 5/2010 | Godfrey et al. | |
| 2015/0283023 | A1 | 10/2015 | Phillips | |
| 2017/0156479 | A1 * | 6/2017 | Kwong | A45F 4/02 |
| 2018/0256442 | A1 * | 9/2018 | Lee | A61H 15/0078 |
| 2020/0375841 | A1 * | 12/2020 | Owusu | A61H 15/02 |

* cited by examiner

*Fig. 1A Vibrating Roller*
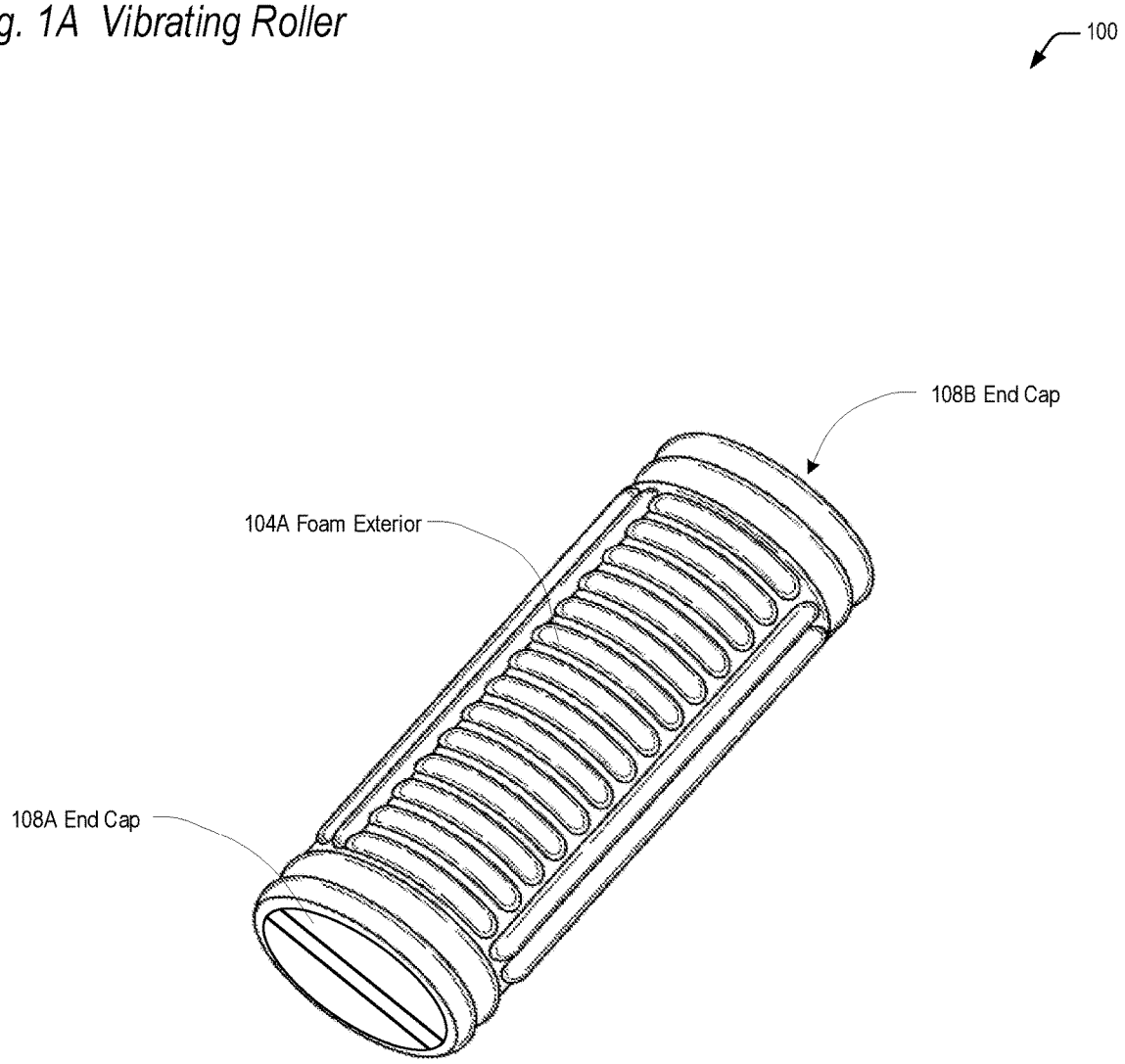

*Fig. 1B Vibrating Roller*
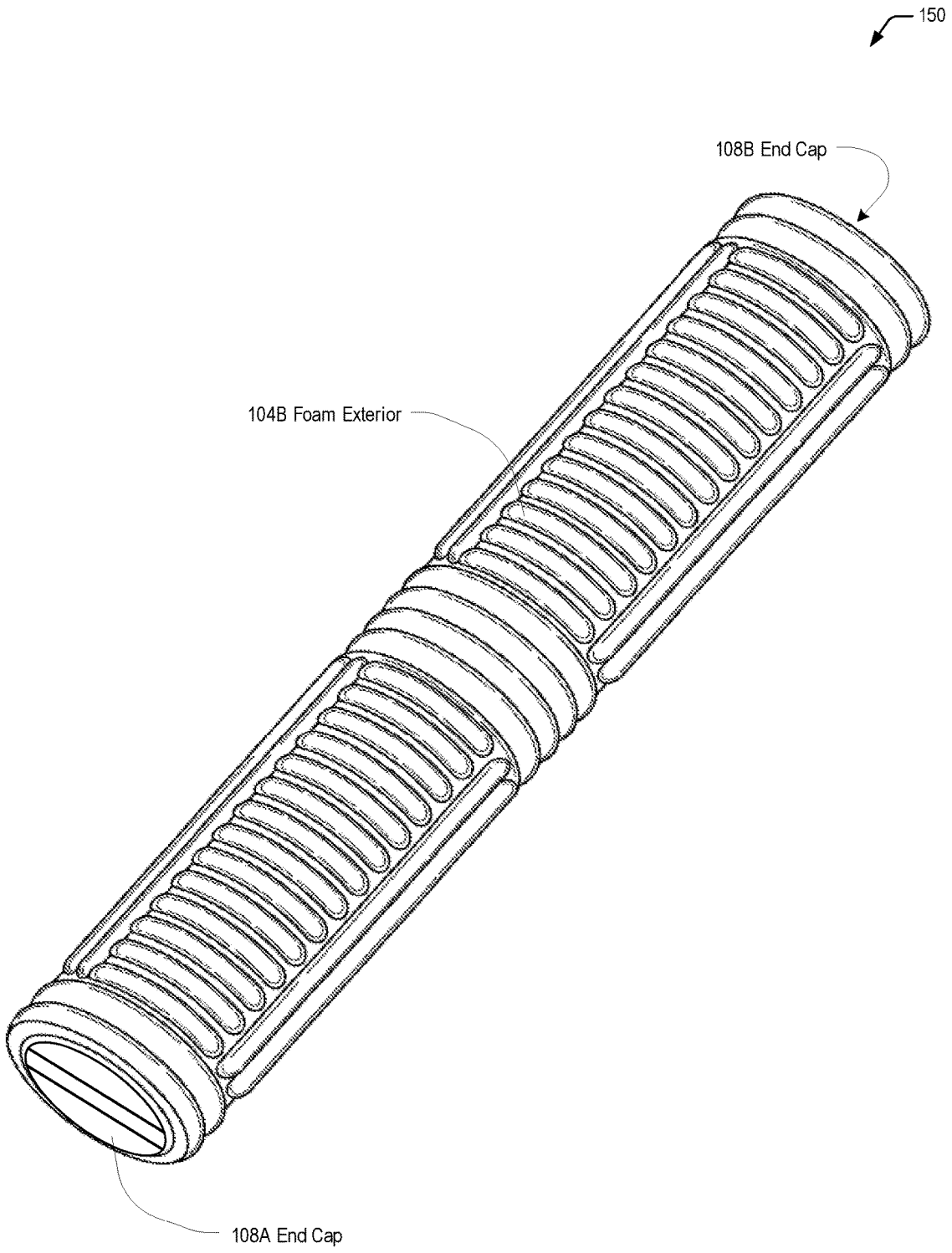

*Fig. 2 Vibrating Roller Block Diagram*
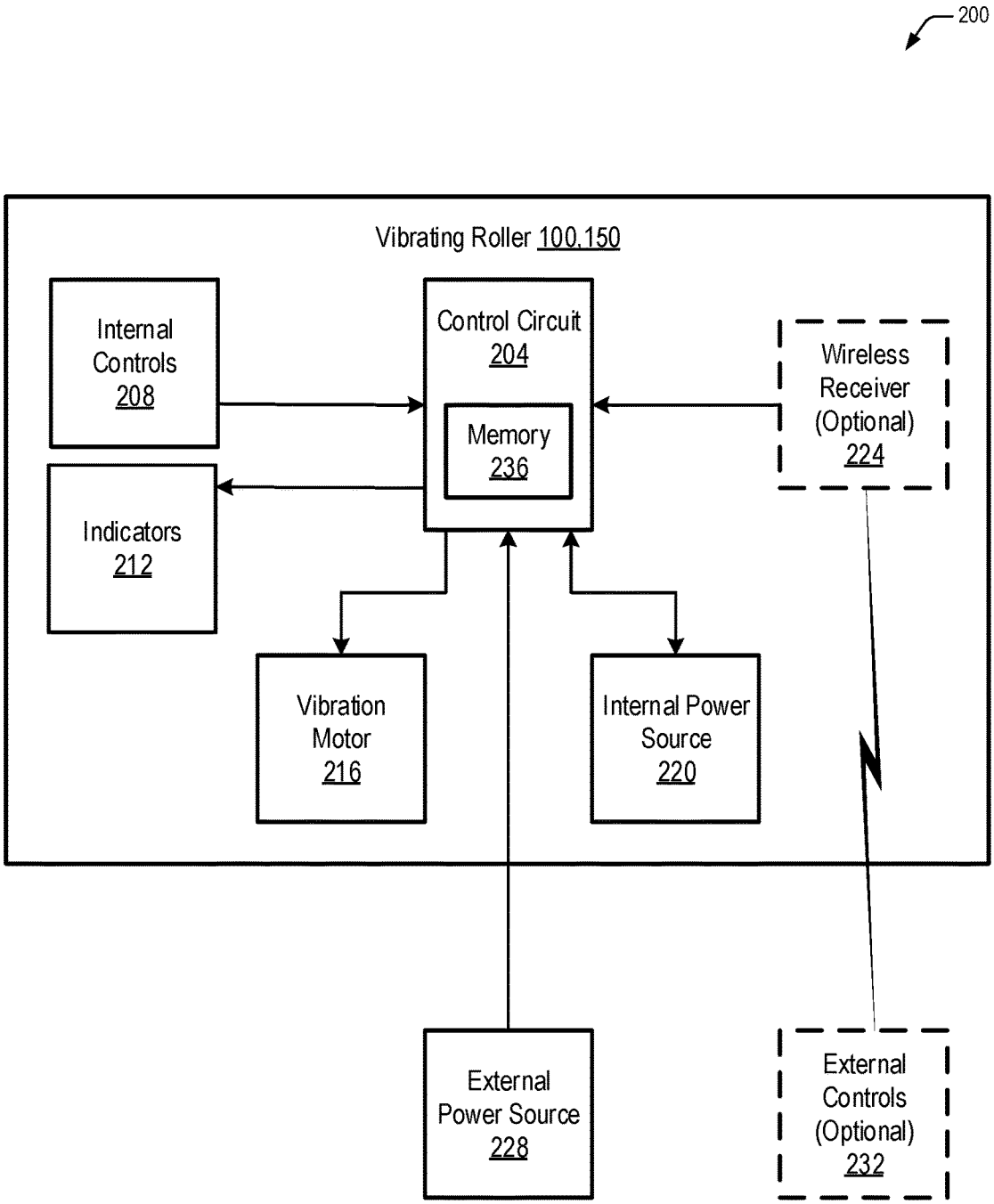

*Fig. 3 Vibrating Roller Exploded View*
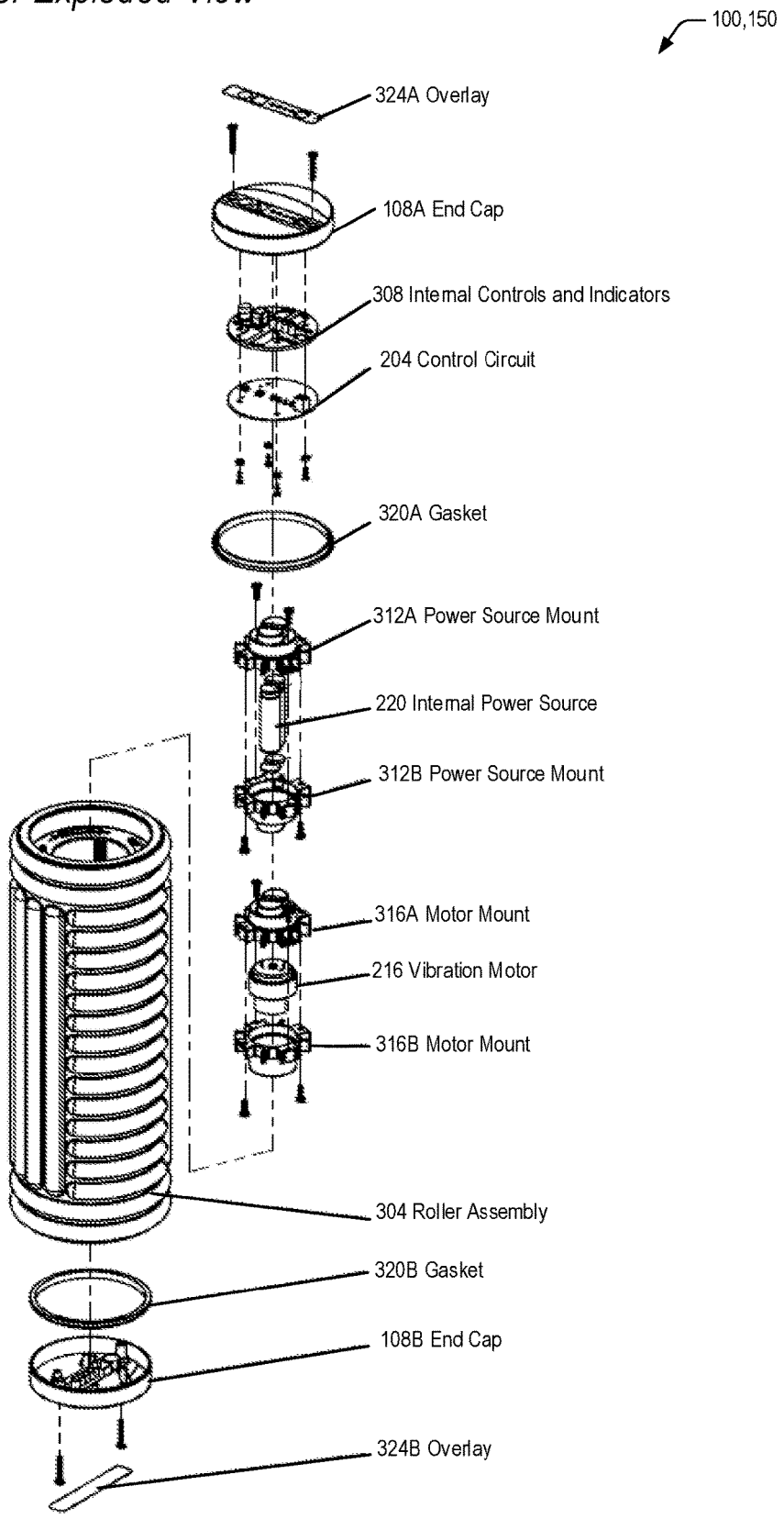

*Fig. 4A Metal Tube*
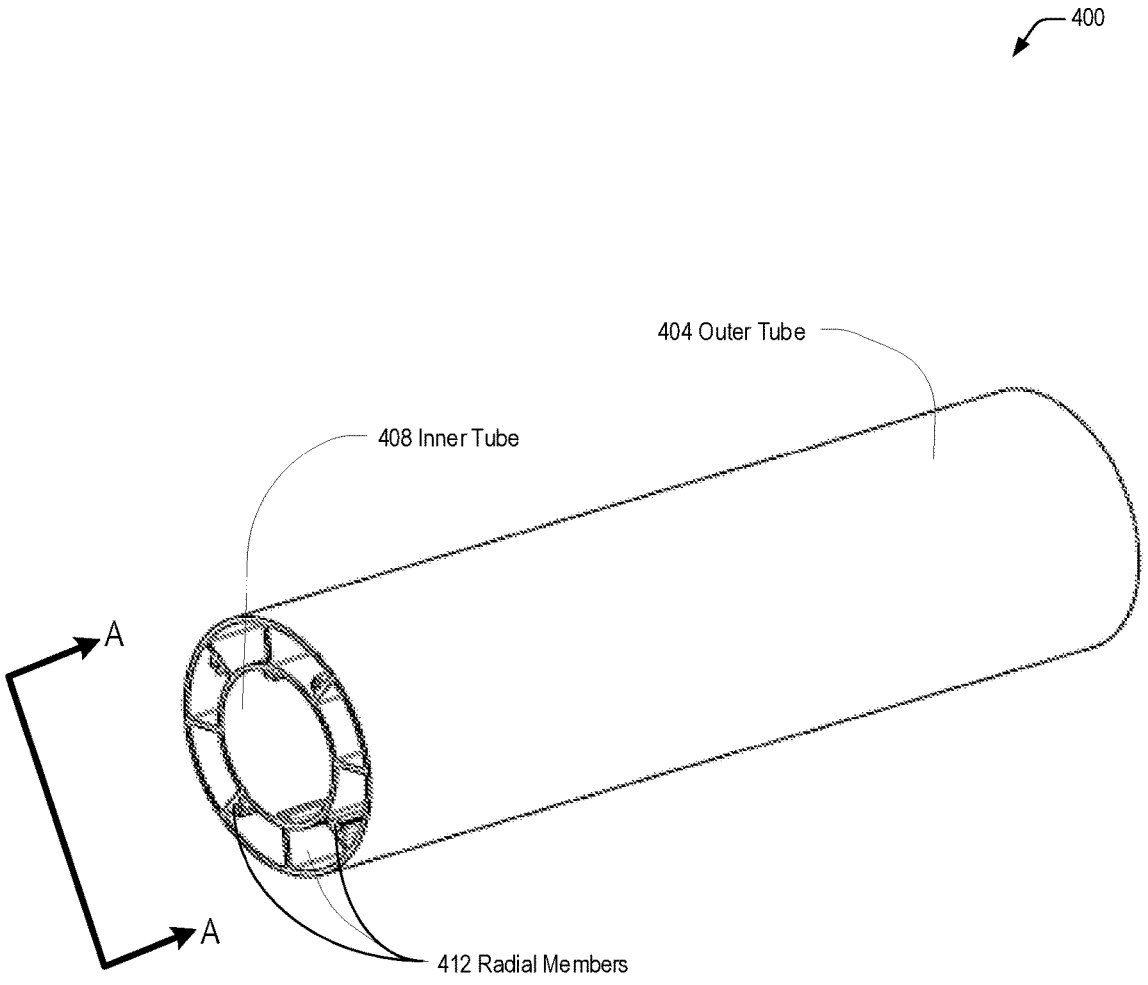

*Fig. 4B View A-A of Metal Tube*
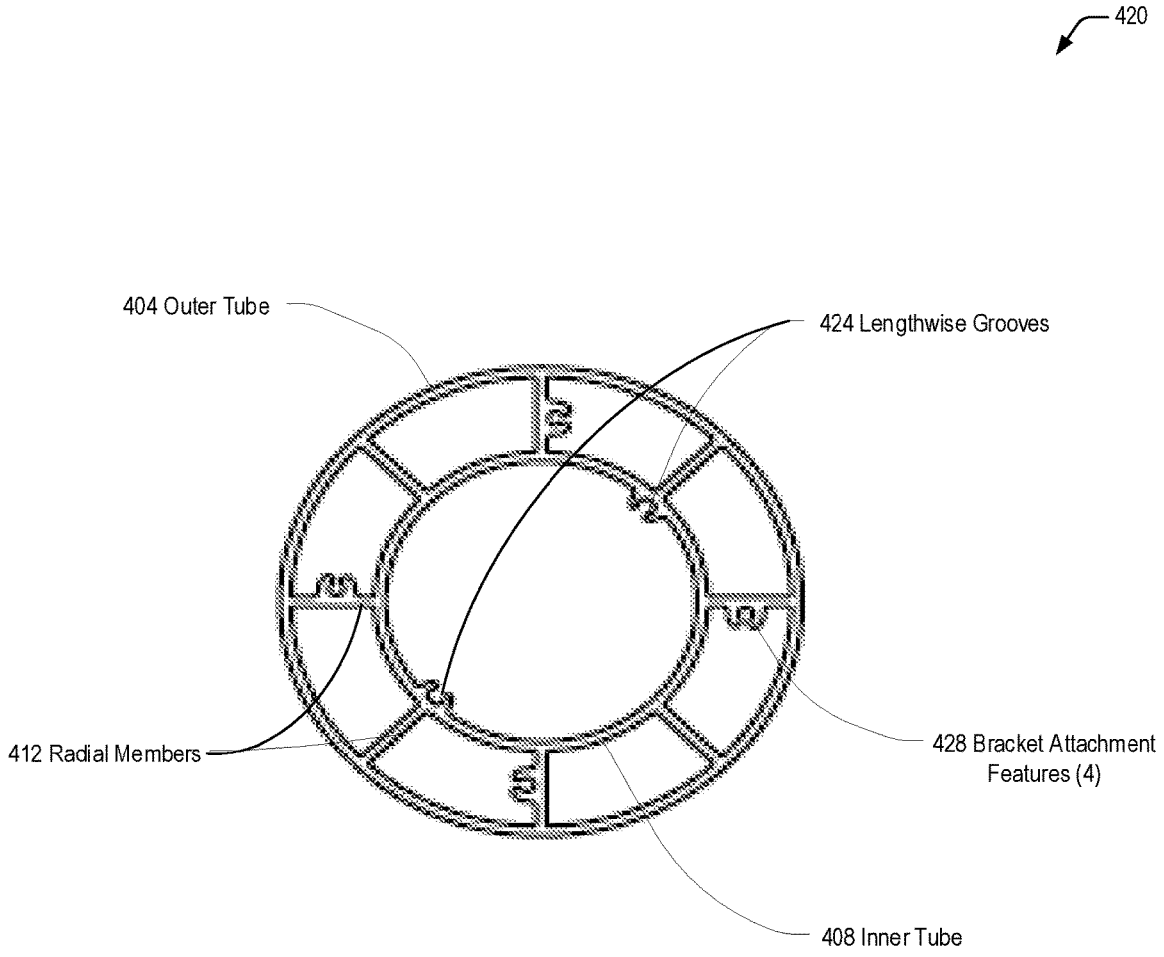

*Fig. 4C Metal Tube Assembly*
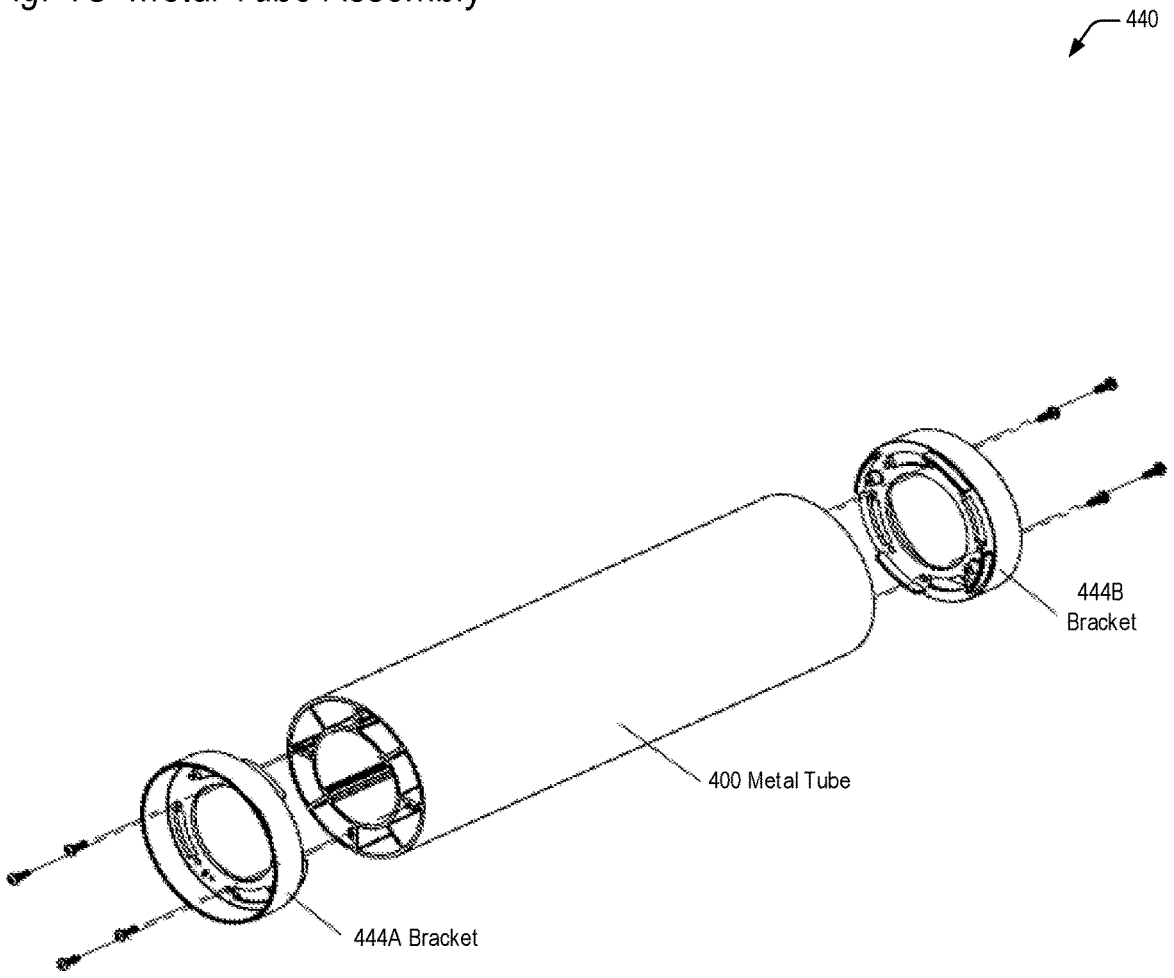

*Fig. 4D Roller Assembly*
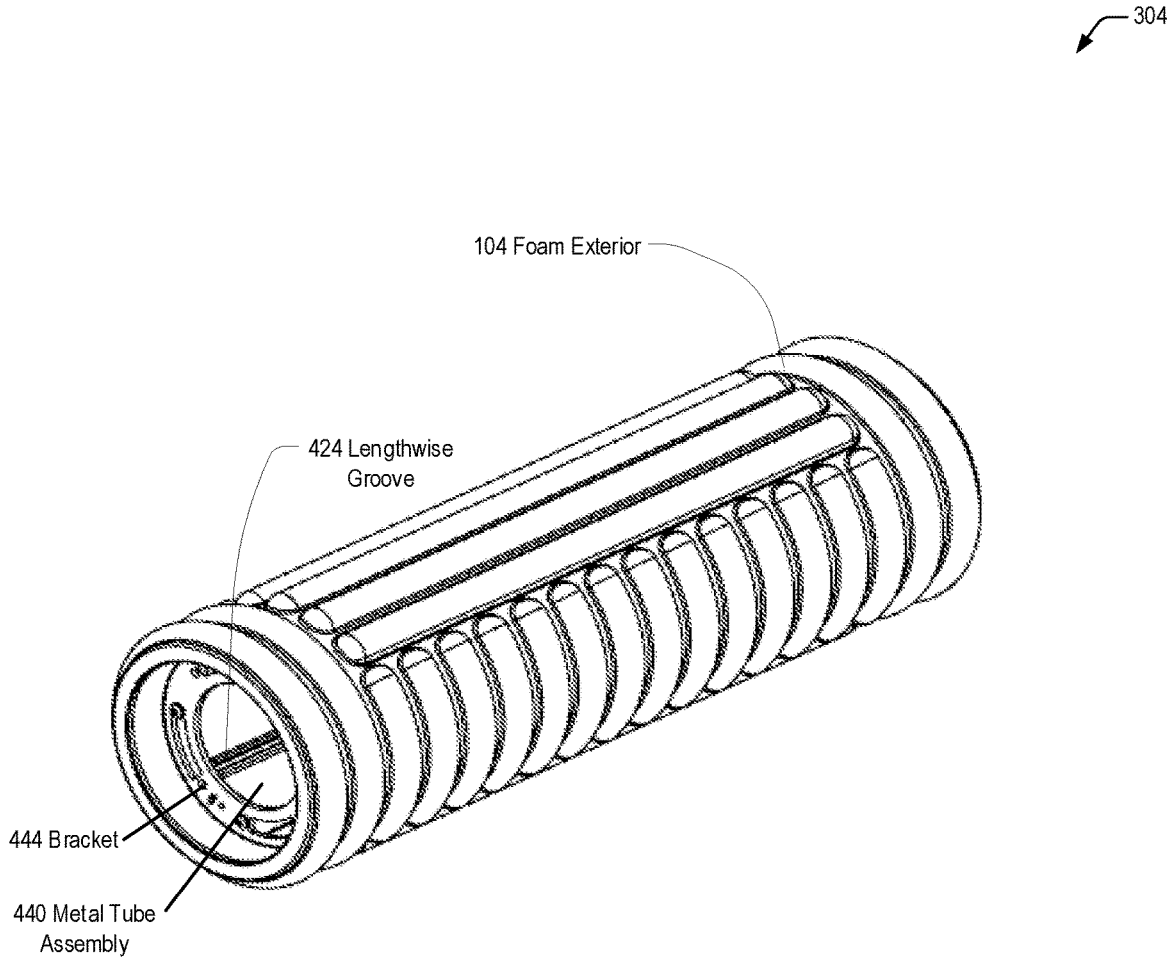

*Fig. 5A Mounted Motor Installation*
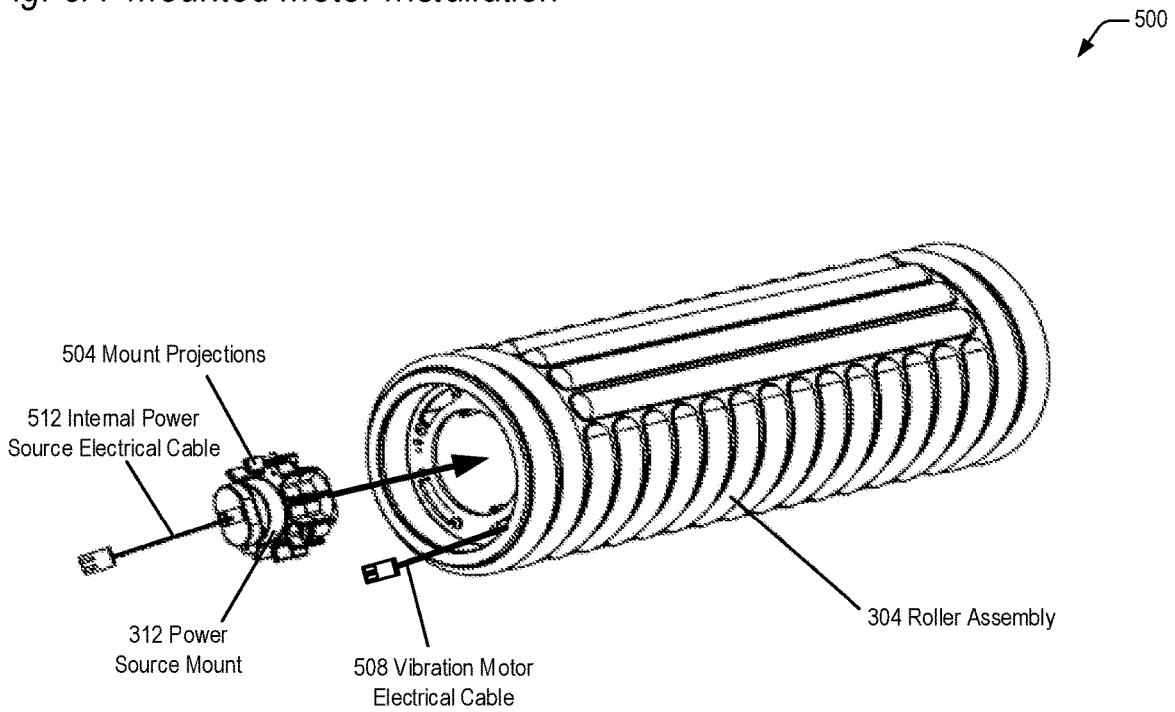
*Fig. 5B Mounted Motor and Internal Power Source Positioning*
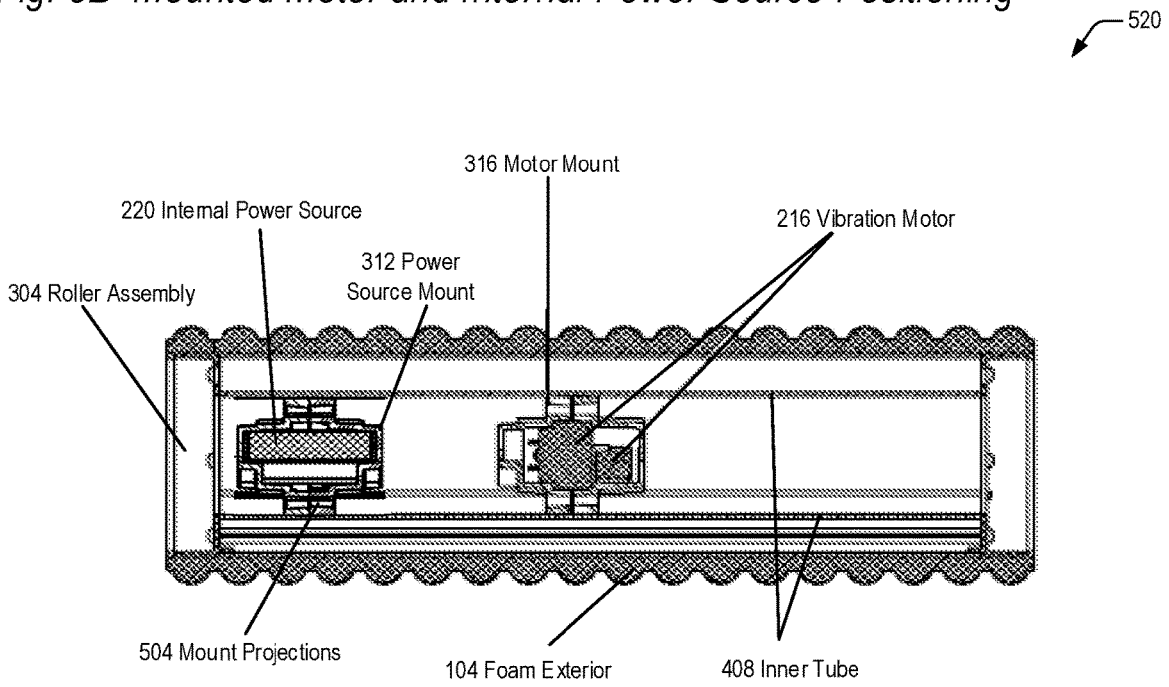

*Fig. 5C End Cap Assembly*
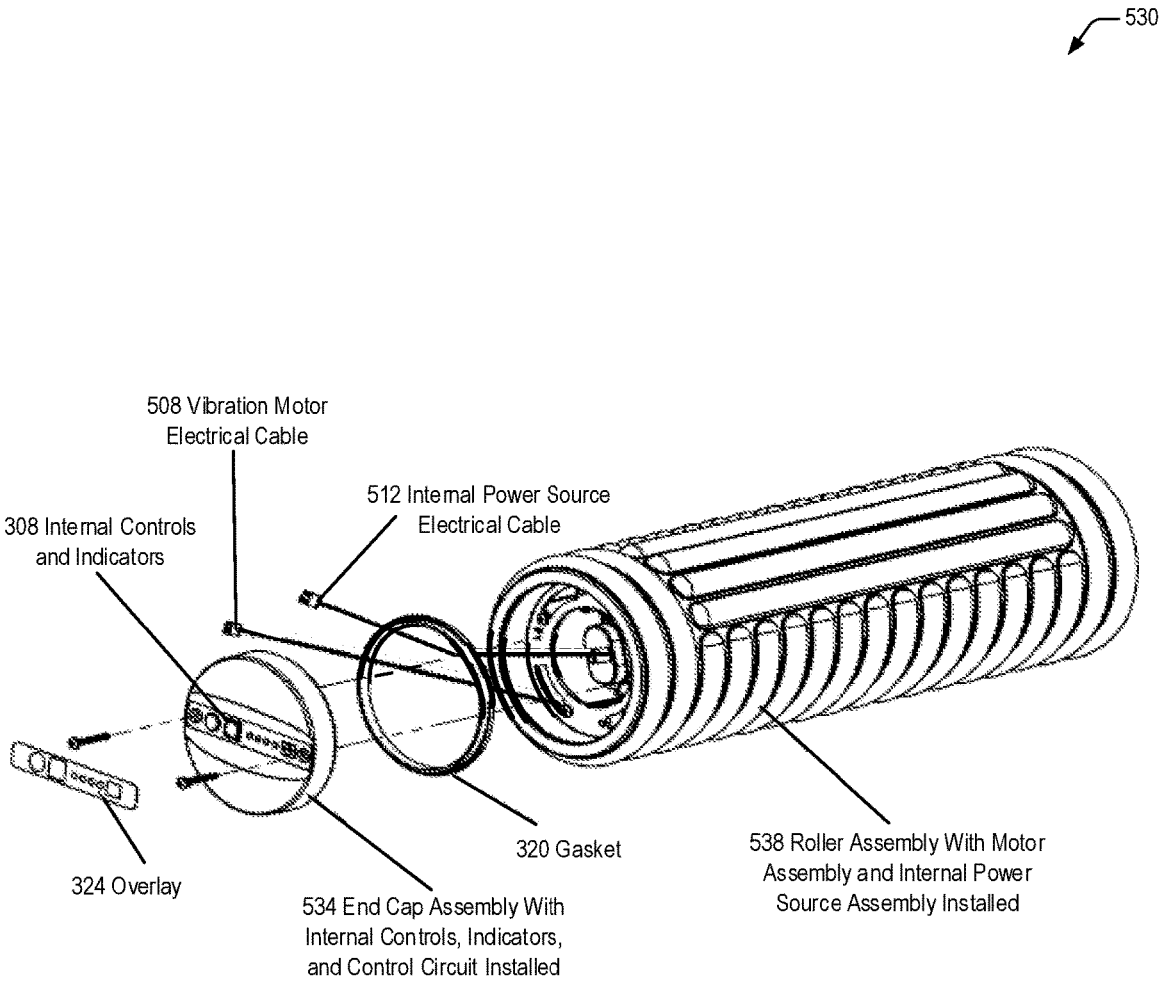

*Fig. 6 Vibration Motor and Internal Power Source Connections*
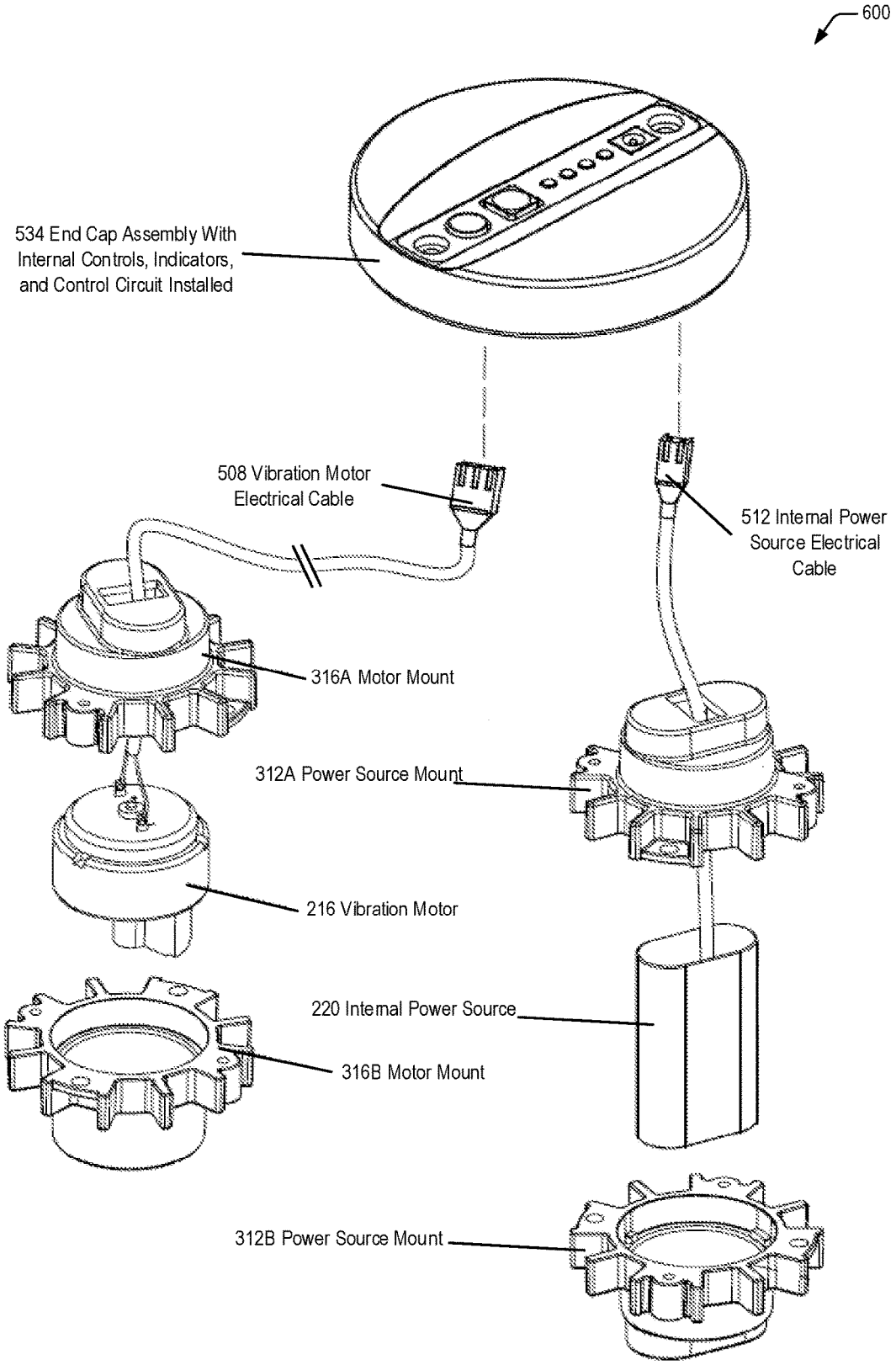

*Fig. 7 Vibrating Roller Assembly Process*
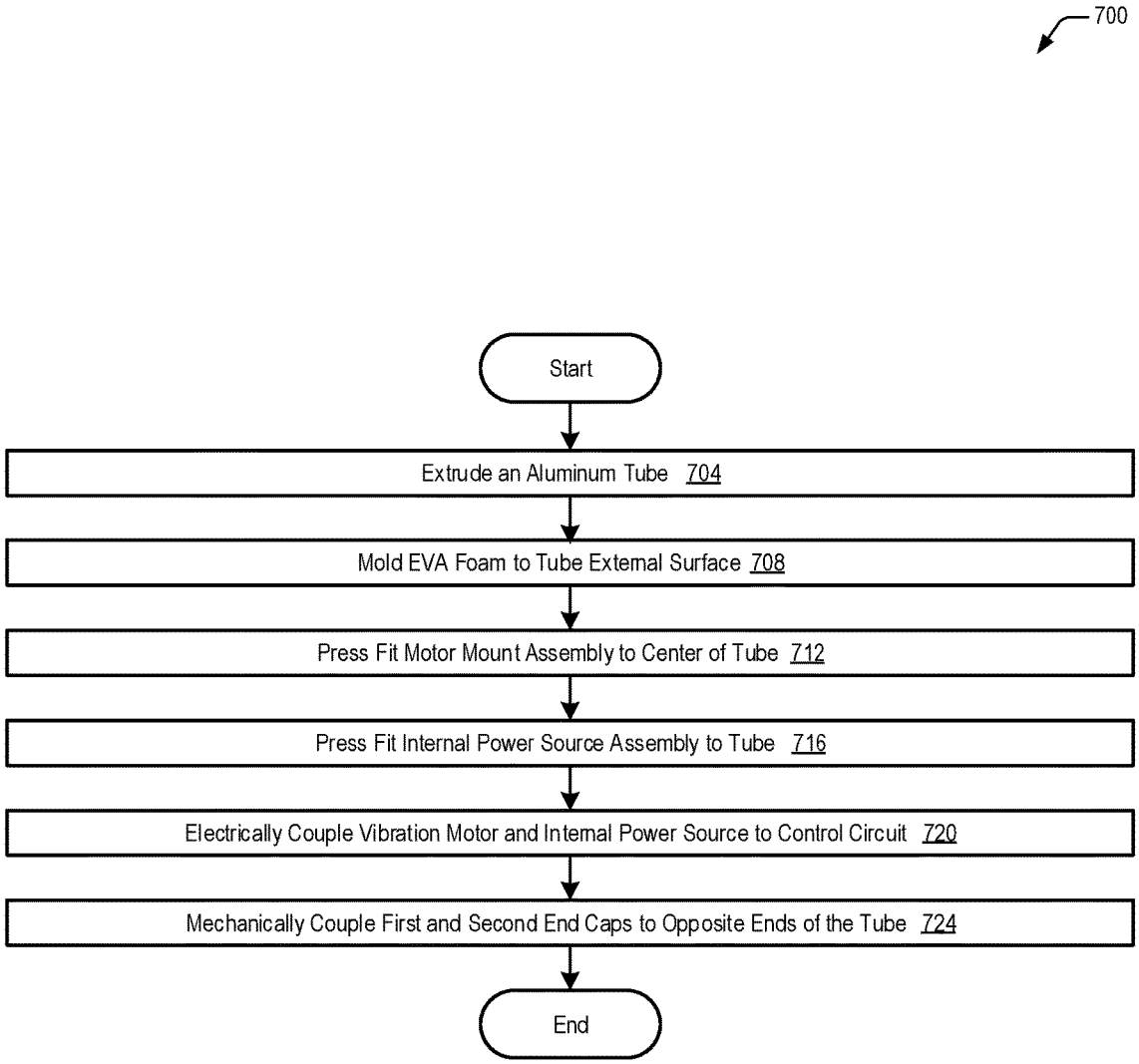

VIBRATING ROLLER

FIELD

The present invention is directed to a vibrating roller for exercise or therapeutic use. In particular, the present invention is directed to structures and manufacturing methods for vibrating rollers incorporating a single-piece rigid internal structure.

BACKGROUND

Foam rollers are easy-to-use fitness tools that may soothe pain, quicken recovery from exercise, and reduce injury. With age, occasional muscle soreness can become part of daily life, but if those aches and pains slow individuals down, they may find relief from a foam roller—a small, lightweight cylinder of compressed foam. After spending decades on the fitness fringes, foam rolling become more popular in recent decades. Whole classes are now devoted to the practice of slowly rolling different parts of the body over a foam tube; it is thought to improve athletic performance and flexibility, reduce exercise-related soreness, reduce recovery time, and relieve muscle pain. Studies have shown that the best results occur when the foam roller is used for 30 to 90 seconds on each muscle, and combined with static stretching. The exercise should not be done daily, but two or three times a week to avoid overworking the muscles. It may be used for many reasons, including increasing flexibility, reducing soreness, and eliminating muscle knots. Rollers may be available in different sizes and degrees of firmness. The firmness (sometimes identified by the color) can range from soft to firm, with soft being usually preferred for beginners. Foam rolling is often described as a form of "self-myofascial release" (sometimes known as SMR). "Fascia" refers to connective tissue that binds and stabilizes the muscles. By massaging muscles using a foam roller, not only can muscles' range of motion be improved, but blood circulation may be improved, tightness or knots in muscles may be reduced, and muscle tissue integrity may be bolstered. Use of foam rollers may be part of everyday exercise or a part of a physical therapy regimen.

SUMMARY

In accordance with an embodiment of the present invention, a vibration device is provided. The vibration device may include one or more of an aluminum tube of cylindrical disposition, including exterior and interior surfaces, a foam roller, coupled to and disposed around the exterior surface of the tube and of a similar length as the tube, a pair of end caps, coupled to each end of one or more of the tube and foam roller, a power source, disposed within the tube, and a motor, coupled to the interior surface and centrally disposed within the tube. The motor is configured to impart vibration to the tube and the foam roller in response to the motor energized by the power source.

In accordance with another embodiment of the present invention, a vibration device is provided. The vibration device may include an aluminum tube of cylindrical disposition, which includes an outer tube including an exterior surface, an inner tube, concentric with the outer tube, including an interior surface that includes a plurality of evenly spaced lengthwise grooves, and four or more radial members, disposed between and directly coupled to the outer and inner tubes. The vibration device may also include a foam roller, molded to and disposed around the exterior surface, a pair of end caps, each coupled to an end of the aluminum tube, an internal power source, disposed within the inner tube, a motor mount, lengthwise centrally disposed within the inner tube and secured to the interior surface by the plurality of lengthwise grooves, a motor, captured within the motor mount and configured to impart vibration to the aluminum tube and the foam roller in response to the motor energized by the power source, and one or more user controls, configured to one or more of initiate, stop, and change vibration for the vibrating roller, and a control circuit, coupled to the one or more controls, the power source, and the motor, configured to selectively switch and regulate the power source to the motor in accordance with the one or more user controls.

In accordance with yet another embodiment of the present invention, a method is provided. The method includes one or more of extruding an aluminum tube, molding EVA form around an exterior surface of the tube, press-fitting a motor mount assembly into the tube, press-fitting an internal power source assembly into the tube, electrically coupling the vibration motor and the internal power source to a first end cap including a control circuit, and mechanically coupling a second end cap and the first end cap to opposite ends of the tube. The motor mount assembly is centrally disposed within the tube and includes a motor mount mechanically coupled to a vibration motor within the motor mount. The internal power source assembly includes a power source mount capturing an internal power source within the power source mount.

An advantage of the present invention is it provides a structure for providing efficient vibration coupling from an internal vibration motor to an exterior form layer. A one-piece aluminum extrusion couples vibration from the motor to an inner tube, through radial members, to an outer tube. Previous vibrating rollers utilize multiple section rigid layers with various types of fasteners joining the sections. By using a single aluminum section, the present invention has no seams or other fasteners that may loosen with vibration. Vibration amplitude may be lost through seams or fasteners that loosen.

Another advantage of the present invention is it maintains reliable coupling between the aluminum extrusion and the exterior EVA foam layer. The EVA foam layer is directly molded to the exterior of the aluminum extrusion instead of being a separate sleeve that is pulled lengthwise onto the extrusion. This provides improved adhesion to the aluminum extrusion, which translates to coupling vibration more efficiently than a separate foam sleeve.

Yet another advantage of the present invention is it provides improved ease of assembly. By molding the EVA foam layer over the aluminum extrusion, any length of vibration roller may be manufactured with equal ease. Foam sleeves that must be pulled over a rigid layer, on the other hand, are significantly more difficult to pull over longer rigid layers than shorter rigid layers due to increased friction. Depending on the foam thickness and strength, this may result in tearing or damaging the foam sleeve as it is pulled onto the rigid layer.

Yet another advantage of the present invention is it requires only a single vibration motor, regardless of roller length. Multiple motor arrangements cost more, usually cancel out or amplify vibration from being at least partially out of sync, and produce vibration hot spots or nulls along the exterior surfaces. Because of the vibration efficiency of the aluminum extrusion and molded EVA foam layer of the present invention, a single centrally located vibration motor evenly distributes vibration to all parts of the outer EVA form layer. This avoids "hot spots" and vibration nulls that hinder vibration effectiveness and therapeutic value.

Yet another advantage of the present invention is it uses an inner tube and outer tube construction for the aluminum extrusion. This allows a larger diameter vibrating roller to be constructed while not requiring a large thickness foam layer. Large diameter foam layers may significantly reduce vibration amplitude and require more powerful or multiple vibration motors to be used—which negatively impacts weight, cost, and battery life. The smaller inner tube allows a smaller size vibration motor to be utilized, which reduces cost and weight while improving battery life.

Additional features and advantages of embodiments of the present invention will become more readily apparent from the following description, particularly when taken together with the accompanying drawings.

BRIEF DESCRIPTION OF THE DRAWINGS

FIG. 1A is an illustration depicting a vibrating roller in accordance with embodiments of the present invention.

FIG. 1B is an illustration depicting a vibrating roller in accordance with embodiments of the present invention.

FIG. 2 is an illustration depicting a vibrating roller block diagram in accordance with embodiments of the present invention.

FIG. 3 is an exploded view illustration depicting a vibrating roller in accordance with embodiments of the present invention.

FIG. 4A is an illustration depicting a metal tube in accordance with embodiments of the present invention.

FIG. 4B is an illustration depicting a view A-A of a metal tube in accordance with embodiments of the present invention.

FIG. 4C is an illustration depicting metal tube assembly in accordance with embodiments of the present invention.

FIG. 4D is an illustration depicting a roller assembly in accordance with embodiments of the present invention.

FIG. 5A is an illustration depicting a mounted motor installation in accordance with embodiments of the present invention.

FIG. 5B is an illustration depicting a mounted motor and internal power source positioning in accordance with embodiments of the present invention.

FIG. 5C is an illustration depicting an end cap assembly in accordance with embodiments of the present invention.

FIG. 6 is an illustration depicting vibration motor and internal power source connections in accordance with embodiments of the present invention.

FIG. 7 is a flowchart illustrating a vibrating roller assembly process in accordance with embodiments of the present invention.

DETAILED DESCRIPTION

The present invention is directed to apparatuses, methods, and systems for providing a vibrating roller for exercise and physical therapy applications. Vibrating rollers are generally tubular/cylindrical in shape, with an internal vibration actuator, a rigid or semi-rigid structure, and a resilient outer covering. Although some foam rollers may have a vibrating feature, in general vibrating rollers may be considered to be heavier, more robust, and with a more useful vibration range than foam rollers.

Vibrating rollers may differ greatly in real and perceived quality. Some may utilize a fabric or carpet exterior, plastic skeleton/structure, and multiple vibration actuators. In some cases, there may not be a close fit between exterior foam or fabric and the underlying structure, which may make assembly less expensive or faster. Some foam or fabric exteriors may also have no or little texturing, which may inhibit vibration effectiveness.

Untextured or consistently textured vibration rollers (i.e. with texturing reflecting only a single direction around the roller exterior) may provide only limited utility for therapeutic applications. On the other hand, the present application describes both longitudinal and circumferential foam rib directions, which provide options of myofascial release intensity. Based on the direction on the foam pattern engaged, users will experience a stronger or less intense massage based on their personal preference.

Effective vibration rollers require efficient vibration translation from the vibration actuator(s) to the outer covering. Efficient in this context means even distribution of vibration amplitude to all exterior covering surfaces around the circumference of the roller and minimal amplitude loss between the vibration actuator within the roller and the external covering. Even distribution of vibration amplitude minimizes "hot spots" and "weak spots" on the roller exterior, which may severely limit the usefulness of a vibration roller for therapeutic purposes. Vibration amplitude loss may be due to materials that do not efficiently translate vibration, thick resilient materials, poor fit between materials, weak vibration actuator(s), weak power sources, mechanical fasteners, and other causes.

In order to provide a high perceived vibration amplitude, previous vibrating rollers may utilize a large vibration actuator or multiple vibration actuators. Large or multiple vibration actuators may either require an external power source such as a "wall wart" or other form of AC/DC power supply, or a large capacity internal power source such as a large single battery or a battery bank. Such forms of power may limit portable use of a vibrating roller because of added weight and in some cases requiring use in close proximity to an AC power source. These forms of power may also limit run time between battery replacement or battery recharging. Multiple vibration actuators may beneficially provide a higher peak vibration amplitude to a vibrating roller, especially at the ends of a tubular structure, but because such actuators generally provide sinusoidal vibration and are almost always not in tight synchronization, the vibration peaks and valleys tend to both cancel out and reinforce each other among the actuators. This may result in uneven vibration and lack of effectiveness and satisfaction in use.

Therefore, what is needed is a portable vibrating roller that can be made in multiple lengths, with high quality, portability with long run time, multiple exterior textures, a useful degree of exterior material resilience, multiple vibration amplitudes, a single vibration actuator, and even vibration distribution.

Referring now to FIG. 1A, an illustration depicting a vibrating roller 100, in accordance with embodiments of the present invention is shown. The embodiment illustrated in FIG. 1A illustrates a vibrating roller 100 of a common 18" length. Vibrating rollers 100 of similar length are valued for portability and light weight. Vibrating roller 100 may be of a generally cylindrical shape, approximately 6" in diameter, and weigh approximately 7 lbs. Vibrating roller 100 includes an internal power source 220, a vibration motor 216, and a rigid tubular internal structure that will be described in more detail with respect to the remaining figures.

Visible in FIG. 1A is a foam exterior 104A, a first end cap 108A, and (not visible) a second end cap 108B. The foam exterior 104A is preferably molded EVA foam material, with a defined exterior texture. In the preferred embodiment, the foam exterior 104A includes groups of alternating semicircular "rolls" (in cross section) that are oriented either lengthwise or around a partial circumference of the vibrating roller 100. There are two groups of 14 parallel partial rolls arranges circumferentially on opposite side of the roller 100, separated by two groups of two lengthwise rolls on opposite side of the roller 100. Each end includes two parallel semicircular rolls that circle the entire roller. Each roll has a diameter of approximately 6 inches.

In a preferred embodiment, the density of the foam exterior 104A may be approximately foam durometer HA50+/−3 degrees. Although the preferred embodiment includes the illustrated and described texture, it should be understood that many other shapes, styles, sizes, and forms of external texturing of the foam exterior 104A may be used without deviating from the present invention, and all such alternatives are contemplated by the present application.

Each end of the vibrating roller 100 may include an end cap 108. In the illustration, end cap 108A is visible but end cap 108B is not. However, it should be understood that there may be an end cap 108 present on each end of the vibrating roller 100. End caps 108 seal the ends of the vibrating roller 100 in order to reduce noise from the vibration motor 216 and keep dirt, dust, and objects from entering the interior of the vibrating roller 100. End caps 108 may additionally provide one or more controls 208, indicators 212, and power connections, and may allow interior access to change/replace batteries or perform maintenance operations.

Referring now to FIG. 1B, an illustration depicting a vibrating roller 150, in accordance with embodiments of the present invention is shown. FIG. 1B illustrates a longer vibrating roller 150 than shown in FIG. 1A, with a similar width to the FIG. 1A embodiment but having an approximately 36 inch length. Such a length may be advantageous because a longer vibrating roller may better support the spine, pelvis, and neck in a safe manner compared to a shorter roller. A longer length may also allow a user to roll both legs at the same time and support overall larger users.

Vibrating roller 150 is of a generally cylindrical shape, approximately 6" in diameter, and weighs approximately 13 lbs. Vibrating roller 150 includes an internal power source 220, a vibration motor 216, and a rigid tubular internal structure that will be described in more detail with respect to the remaining figures.

Vibrating roller 150 may include a foam exterior 104B different than foam exterior 104A but similar end caps 108. The foam exterior 104B is preferably molded EVA foam material, with a defined exterior texture. In a preferred embodiment, the density of the foam exterior 104B may be approximately foam durometer HA50+/−3 degrees. In the illustrated embodiment, the foam exterior 104A includes groups of alternating semicircular "rolls" (in cross section) that are oriented either lengthwise or around a partial circumference of the vibrating roller 150. At the center of vibrating roller 150 are four parallel circumferential rolls that extend around the entire roller 150. On each side of the center section, there are two groups of 14 parallel partial rolls arranged circumferentially on opposite side of the roller 150, each separated by two groups of two lengthwise rolls on opposite side of the roller 150. Each end includes two parallel semicircular rolls that circle the entire roller. Each roll has a diameter of approximately 6 inches. Aside from the illustrated and described differences between foam exteriors 104A and 104B, other components and features of vibrating rollers 100 and 150 may be identical. This may advantageously allow a family of different length vibrating rollers 100, 150 to be manufactured with common components, which may reduce costs and simplify production and maintenance.

Referring now to FIG. 2, an illustration depicting a vibrating roller block diagram 200, in accordance with embodiments of the present invention is shown. Each vibrating roller 100, 150 may include various components that allow a user to initiate, stop, and control vibration. A vibration motor 216 vibrates a housing coupled to the vibration motor 216. In the preferred embodiment, only one vibration motor 216 is required, whether for a standard length vibrating roller 100 or a longer vibrating roller 150.

Vibrating roller 100, 150 may include a control circuit 204. The control circuit 204 may include a digital microcontroller or microprocessor and an associated memory device 236, or include analog circuitry instead of or in addition to the digital components. The control circuit 204 provides interfaces to all electrical or electronic assemblies associated with the vibrating roller 100, 150.

Central to the vibrating roller 100, 150 is a vibration motor 216, which vibrates according to commands and power that pass through the control circuit 204. The vibration motor 216 may be either internally or externally powered, relative to the vibrating roller 100, 150. An internal power source 220 may supply DC power to the control circuit 204, and in some embodiments may be a rechargeable power source including one or more rechargeable batteries. In other embodiments, the DC power source may include non-rechargeable batteries. In yet other embodiments, the vibrating roller 100, 150 may not include an internal power source 220 or have an internal power source 220 currently installed. In some embodiments, the vibrating roller 100, 150 may also support an external power source 228 that provides DC power to the control circuit 204—either instead of or in addition to the internal power source 220. The external power source 228 may receive AC power and convert the AC power into DC power. When the internal power source 220 includes rechargeable batteries, when the external power source 228 is providing DC power to the control circuit 204, the external power source 228 may be used to recharge the internal power source 220. In one embodiment, when the external power source 228 is providing DC power to the control circuit 204, all available DC power is provided to the vibration motor 216. In another embodiment, when the external power source 228 is providing DC power to the control circuit 204, when the vibration motor 216 is not running, the DC power recharges the internal power source 220. In yet another embodiment, when the external power source 228 is providing DC power to the control circuit 204, the DC power both powers the vibration motor 216 and recharges the internal power source 220.

The internal power source 220 and/or the external power source 228 may provide power to the vibration motor 216, the control circuit 204, the indicators 212, and the wireless receiver 224 or wireless transceiver 224. In one embodiment, the control circuit 204 may detect the presence and voltage of the internal power source 220 and/or the external power source 228. In another embodiment, the vibrating roller 100, 150 may utilize only the external power source 228 if the external power source 228 is available, regardless of the presence or absence of an internal power source 220.

The control circuit 204 may include an interface to illuminate one or more visual indicators 212, or drive an audio transducer 212. Visual indicators 212 may include simple light emitting diodes (LEDs) to indicate any of the internal power source 220 available (i.e. installed and able to provide useful power), an external power source 228 available, an on/off state of the vibrating roller, and one or more performance levels, including vibration intensity. Other forms of visual indicators 212 may be present, including alphanumeric displays, miniature LCDs, etc. Audio transducer indicators 212 may include one or more speakers, beepers, or audio tone generators. In one embodiment, only visual indicators 212 are present. In yet another embodiment, both visual indicators 212 and audio transducer 212 may be present. In yet another embodiment, neither visual indicators 212 nor audio transducer indicators 212 may be present.

The vibrating roller 100 may include internal controls 208 that specify to the control circuit how the vibrating roller 100, 150 operates. Internal controls 208 may include manual controls that a user manipulates, such as one or more pushbuttons, dials, switches, a touch screen, or other forms of controls. For example, internal controls 208 may include an on/off control, one or more vibration speed/intensity controls, battery recharging controls, or power source 220, 228 manual selection controls. In one embodiment, the control circuit 204 may include a memory device 236 that stores a last or a current control setting from the internal controls 208 and/or the external controls 232. The memory device 236 may also store an operating history the vibrating roller 100, 150. The operating history may include a number of entries over a time period, where each entry may include a date and a time stamp of vibration motor 216 activation and deactivation, each vibration level or intensity selected, and possibly a time stamp for each vibration level change. The operating history may also include dates/time stamps for use from the internal power source 220 and/or external power source 228, internal power source 220 replacement and/or recharging dates, and recharging and/or depletion levels. In one embodiment, the vibrating roller 100, 150 performs a stored sequence of an operating history, where each vibration level in the sequence is operated for a predetermined time. The stored sequence may cycle through two or more vibration intensities and may return to previous intensities in the stored sequence.

In one embodiment, the vibrating roller 100, 150 may include a wireless receiver 224. The wireless receiver 224 provides a wireless interface to some form of external controls 232, which may replace or replicate control functions provided by the internal controls 208. The external controls 232 may include a dedicated remote control device, a computer running an application associated with the vibrating roller 100, 150, or a smart phone running an application associated with the vibrating roller 100, 150. The computer may be a tablet, a portable computer including a laptop or notebook computer, a desktop computer, or a server computer. Any of the computing devices may be associated with a computing cloud or cloud storage.

The external controls 232 may provide audio or visual information to the wireless receiver 224, which the wireless receiver 224 may provide through the control circuit 204 to the indicators 212. In one embodiment, the audio or visual information may supplant or replicate control information alternately provided by the internal controls 208. In another embodiment, the audio or visual information may be different from or in addition to the control information from the internal controls 208.

In another embodiment, the wireless receiver 224 may instead be a wireless transceiver 224, able to both transmit and receive information from the external controls 232. Transmitted information may include power information related to either the internal power source 220 and/or the external power source 228, and include one or more of battery levels, voltage levels, remaining battery time at current charge, battery replacement information, battery type information, and battery or power source failure information. The wireless transceiver 224 may also provide memory 236 contents and/or operating history information to the external controls 232. In one embodiment, some or all of the memory 236 contents or operating history may be provided to the external controls 232 each time the external controls 232 makes a wireless connection with the wireless transceiver 224. In another embodiment, some or all of the memory 236 contents or operating history may be provided to the external controls 232 in response to a command received from the external controls 232. In one embodiment, the external controls 232 may provide a command through the wireless transceiver 224 to erase either all memory 236 contents or the operating history stored in the memory 236.

Referring now to FIG. 3, an exploded view illustration depicting a vibrating roller 100, 150, in accordance with embodiments of the present invention is shown. FIG. 3 illustrates the components for a vibrating roller 100, 150. Although the roller assembly 304 is for a vibrating roller 100, it should be understood that the other components are also used in accordance with a longer vibrating roller 150.

The vibration motor 216 is mounted within a motor mount 316. In the illustrated embodiment, the motor mount 316 includes two pieces, identified as motor mount 316A and motor mount 316B, that together capture the vibration motor 216 in a clamshell fashion. In other embodiments, the motor mount 316 may include only a single piece, or more than two pieces 316A, 316B.

The internal power source 220 is mounted within a power source mount 312. In the illustrated embodiment, the power source mount 312 includes two pieces, identified as power source mount 312A and power source mount 312B, that together capture the internal power source 220 in a clamshell fashion. In other embodiments, the power source mount 312 may include only a single piece, or more than two pieces 312A, 312B.

Gaskets 320 at each end of the roller assembly 320, identified as gasket 320A and 320B, provide an environmental seal to the interior of the roller assembly 304. The seal may provide any of a water seal or an air seal, and/or provide some vibration dampening to the end caps 108 and associated components.

End caps 108, identified as end cap 108A and end cap 108B, are mounted to each end of the roller assembly 304. An overlay 324, identified as overlay 324A and overlay 324B, may be affixed to an outside surface of one or more end caps 108. Overlays 324 may include one or more of a logo, a model number, control or indicator functions, or a company name. One or more end caps 108 may include various electronic assemblies 308 of a vibrating roller 100, 150, including a control circuit 204, internal controls 208, indicators 212, and a wireless receiver/transceiver 224. These electronic assemblies may be packaged in many different ways, including some in each end cap 108 of a vibrating roller 100, 150.

Referring now to FIG. 4A, an illustration depicting a metal tube 400, in accordance with embodiments of the present invention is shown. The vibrating roller 100, 150 is built around a metal tube 400. The metal tube 400 may be preferably made from aluminum, in order to provide high rigidity and efficient vibration translation, combined with light weight. In a preferred embodiment, the metal tube 400 is made from 6063 aluminum. Other metals may be used, although with different combinations of weight, strength, and vibration translation. Section A-A provides an end-on view which is shown and described in more detail with respect to FIG. 4B.

In the preferred embodiment, an extrusion process is used to form the metal tube 400. Extrusion is a type of forming process in which a metal is confined in a closed cavity and then allowed to flow through only one opening so that the metal takes the shape of the opening. As such, extrusion is a "toothpaste tube" process. Forcing a metal billet through a die creates a length of uniform cross-section material. Manufacturing companies employ extrusion molding to make products with a consistent cross-section.

The metal tube 400, being formed by extrusion, may be of any practical length as long as sufficient aluminum material is available. In the preferred embodiment, the metal tube 400 is formed in lengths allowing 18" 100 and 36" 150 vibrating rollers. However, the present invention is not limited to any length of vibrating roller, and the extrusion process allows for any practical length of metal tube 400 to be formed.

In the preferred embodiment, the metal tube is formed as an outer tube 404 of a first diameter and a concentric inner tube 408 of a second diameter less than the first diameter. A number of radial members 412 (preferably four or more) rigidly couple the inner tube 408 to the outer tube 404. In other embodiments, the metal tube 400 may be formed as a single outer tube 404 without an inner tube 408 or radial members 412. Because the metal tube 400 is an aluminum extrusion in the preferred embodiment, the outer tube 404, the inner tube 408, and the radial members 412 have no joints between them and there are no fasteners required to join them. Advantageously, this results in a more rigid metal tube 400 structure that is better able to uniformly translate vibration to all points on the outer tube 404, without requiring fasteners that may loosen with prolonged vibration. Extrusion also is more reliable for prolonged use over welded seams between the outer tube 404, inner tube 408, and the radial members 412 that may fracture over time.

By using an outer tube 404 and inner tube 408 construction, a desired outside diameter of the vibrating roller 100, 150 may be independent from a size of the internal power source 220, power source mount 312, vibration motor 216, and motor mount 316. For example, this may allow a same internal power source 220, power source mount 312, vibration motor 216, and motor mount 316 to be used with different diameter vibrating rollers 100, 150.

Because the metal tube 400 is preferably an extrusion, all structural surfaces extend for the entire length of the tube 400. Thus, the radial members 412 extend for the length of the tube 400, and provide more even vibration translation from the inner tube 408 to the outer tube 404 than other vibration tubes that only have the radial members 412 in close proximity to each end, and no radial members 412 substantially near the center of the tube.

Referring now to FIG. 4B, an illustration depicting a view A-A of a metal tube 420, in accordance with embodiments of the present invention is shown. FIG. 4B illustrates an end view of the metal tube 400, showing the outer tube 404, inner tube 408, and radial members 412. Eight equally-spaced radial members 412 are shown, although there may be less or more present. Also visible are bracket attachment features 428 and lengthwise grooves 424. Four bracket attachment features 428 are shown in FIG. 4B, which provide attachment features for brackets 444 to be attached to the tube 400. The bracket attachment features 428 are formed in four of the eight radial members 412. Two lengthwise grooves 424 are formed on an inner surface of the inner tube 408. The lengthwise grooves 424 provide attachment points for the power source mount 312 and motor mount 316 shown in FIGS. 3 and 6. Although two lengthwise grooves 424 are shown, there may be more than two lengthwise grooves 424 in other embodiments. Because the metal tube 400 in the preferred embodiment is an aluminum extrusion, the lengthwise grooves 424 and the bracket attachment features 428 extend for the entire length of the tube 400.

Referring now to FIG. 4C, an illustration depicting a metal tube assembly 440, in accordance with embodiments of the present invention is shown. The metal tube assembly 440 includes a bracket 444 attached at each end by fasteners. In the illustrated embodiment, there are two brackets 444 shown, identified as brackets 444A and 444B. Brackets 444 are included in each roller assembly 304, and provide attachment surfaces for gaskets 320 and end caps 108. Each bracket 444 is shown secured with four fasteners. In other embodiments, fewer or more than four fasteners may be used, and different fastener types may also be utilized. In one embodiment, brackets 444 may be made from aluminum. In other embodiments, brackets 444 may be made from a different metal material or from a synthetic or polymer material.

Referring now to FIG. 4D, an illustration depicting a roller assembly 304, in accordance with embodiments of the present invention is shown. The roller assembly 304 may be any length, and includes a metal tube assembly 440, which includes a pair of brackets 444 (one bracket 444 shown). A single lengthwise groove 424 is visible on an inside surface of the metal tube assembly 440 (i.e. on an inside surface of the inner tube 408).

A foam exterior 104 is affixed to the exterior of the metal tube assembly 440. In the preferred embodiment, the foam exterior 104 is made from EVA foam and is molded to the exterior of the metal tube assembly 440. Molding advantageously provides a secure and slip-free connection between the foam exterior 104 and the metal tube assembly 440 over previous foam rollers that use a foam sleeve that is slipped over a plastic or metal tube.

Referring now to FIG. 5A, an illustration depicting mounted motor installation 500, in accordance with embodiments of the present invention is shown. The roller assembly 304 includes the foam exterior 104 securely attached to the metal tube assembly 440. At this point, the motor assembly is centrally installed to the roller assembly 304 (not shown). The motor assembly includes the vibration motor 216, the motor mount 316, and the vibration motor electrical cable 508, as shown in FIG. 6. Only the vibration motor electrical cable 508 from the motor assembly is visible, since the rest of the motor assembly has been centrally positioned along the length of the roller assembly 304.

The internal power source assembly is illustrated, ready to install into the roller assembly 304. The internal power source assembly includes the internal power source 220, the power source mount 312, and an internal power source cable 512. The power source mount 504 (and motor mount 316) includes two or more mount projections 504 that engage the longitudinal grooves 424 of the inner tube 408. The mount projections 504 make an interference or friction fit with the longitudinal grooves 424, requiring force applied to the motor mount 316 and power source mount 312 to make a press-fit connection within the roller assembly 304, and seat each assembly to a proper depth.

Referring now to FIG. 5B, an illustration depicting mounted motor and internal power source positioning 520, in accordance with embodiments of the present invention is shown. FIG. 5B leaves out the internal power source electrical cable 512 and vibration motor electrical cable, for clarity, but should be understood to be present as shown in FIGS. 5A and 6.

FIG. 5B shows a central positioning (lengthwise) for the motor mount assembly (which includes the vibration motor 216 and the motor mount 316). The internal power source assembly (which includes the internal power source 220 and the power source mount 312) is positioned closer to an end of the roller assembly 304. Beneficially, this allows shorter electrical cabling 512 to be used for the internal power source assembly, resulting in a lower power drop of delivered power to the control circuit 204. The mount projections 504 engage the longitudinal grooves 424 associated with the inner tube 408.

The motor mount 316 is preferably made from a sufficiently rigid material to efficiently convey vibration directly from the vibration motor directly to the inner tube 408. In one embodiment, the motor mount 316 may be made from a material such as nylon or fiberglass. In another embodiment, the motor mount 316 may be made from aluminum, steel, or another metal alloy. Because the power source mount 312 does not need to efficiently convey vibration, it may be made of either rigid or more resilient materials, including ABS plastics.

Referring now to FIG. 5C, an illustration depicting end cap assembly 530, in accordance with embodiments of the present invention is shown. An end cap 108 has previously been assembled into an end cap assembly with internal controls, indicators, and control circuit installed 534. These components are represented in FIG. 3, and functionally described with respect to FIG. 2. A functional or decorative overlay 324 may have been previously installed, or installed at this point.

The roller assembly with motor assembly and internal power source assembly installed 538 would have the vibration motor electrical cable 508 and the internal power source electrical cable 512 extending through an end. The vibration motor electrical cable 508 and internal power source electrical cable 512 are passed through a gasket 320 and plugged into mating electrical connectors on a rear surface of the end cap assembly 534. The end cap assembly 534 is then attached through the gasket 320 to the roller assembly 538 with appropriate fasteners or other means known in the art. The other end cap 108 is also fastened to the other end (not shown) of the roller assembly 538 through suitable means.

Referring now to FIG. 6, an illustration depicting vibration motor and internal power source connections 600, in accordance with embodiments of the present invention is shown. FIG. 6 illustrates electrical connects between a motor mount assembly, an internal power source assembly, and an end cap assembly 534. The motor mount assembly includes the vibration motor 216, motor mounts 316A and 316B, and a vibration motor electrical cable 508. The internal power source assembly includes the internal power source 220, the power source mounts 312A and 312B, and an internal power source electrical cable 512. One of the end cap assemblies 534 may include the internal controls 208, the indicators 212, and the control circuit 204. After the motor mount assembly and the internal power source assembly have been installed to the roller assembly 304, the vibration motor electrical cable 508 and internal power source electrical cable 512 are plugged into the control circuit 204 within the end cap assembly 534. At this point, the end cap assembly 534 may be secured to the roller assembly 304, as shown and described with respect to FIG. 5C.

Perceived vibration intensity is based on vibration amplitude and frequency. In one embodiment, the vibration amplitude may be characterized at external points on the foam exterior 104 according to different vibration control settings. In another embodiment, a vibrating roller 100, 150 may support three vibrating frequencies. For example, a low vibrating frequency measured at the vibration motor 216 may be approximately 25 hertz, a medium vibrating frequency measured at the vibration motor 216 may be approximately 50 hertz, and a high vibrating frequency measured at the vibration motor 216 may be approximately 75 hertz. Ideal vibration amplitudes and frequencies may be highly subjective, and should be chosen according to perceived effectiveness.

Referring now to FIG. 7, a flowchart illustrating a vibrating roller assembly process 700, in accordance with embodiments of the present invention is shown. Flow begins at block 704.

At block 704, an aluminum tube 400 is extruded. Extrusion is a process used to create objects of a fixed cross-sectional profile. A material is pushed through a die of a desired cross-section. The two main advantages of this process over other manufacturing processes are its ability to create very complex cross-sections, and to work materials that are brittle, because the material only encounters compressive and shear stresses. It also forms parts with an excellent surface finish. Extrusion may be continuous (theoretically producing indefinitely long material) or semi-continuous (producing many pieces). The extrusion process can be done with the material hot or cold. The products of extrusion are generally called "extrudates". Flow proceeds to block 708.

At block 708, EVA foam 104 is molded to the aluminum tube 400 external surface, along its length. Molding the foam 104 directly to the tube 400 has major advantages over pulling a pre-fabricated foam sleeve lengthwise over the tube 400. First, molding the foam 104 provides greater adhesion to the tube 400 exterior than a sleeve pulled into place. Second, a sleeve pulled over the tube 400 may rip or become damaged as increasing pull forces are required to fully pull the sleeve over the tube 400. This may be a very significant problem for a longer tube 400, such as used with vibrating roller 150. This may disadvantageously result in many shorter foam sections required to each be pulled onto the tube 400, in series. Unfortunately, individual sections may then possibly rotate with respect to each other, and gaps may develop between sections. Flow proceeds to block 712.

At block 712, a motor mount assembly is press fit into a center of the roller assembly 304. In the preferred embodiment, the motor mount assembly is as illustrated in FIG. 6, and may include the vibration motor 216, motor mounts 316A, 316B, and a vibration motor electrical cable 508. The press fit of the present application advantageously does not utilize or rely on various fasteners to secure the motor mount assembly that may come loose during expected vibration.

A press fit, also known as an interference fit or friction fit, is a form of fastening between two tight-fitting mating parts that produces a joint which is held together by friction after the parts are pushed together. Depending on the amount of interference, parts may be joined using a tap from a hammer or pressed together using a hydraulic ram. The tightness of fit is controlled by amount of interference and the allowance (planned difference from nominal size). Formulas exist to compute allowance that will result in various strengths of fit such as loose fit, light interference fit, and interference fit. The value of the allowance depends on which material is being used, the size of the parts, and what degree of tightness is desired. Flow proceeds to block 716.

At block 716, an internal power source assembly is press fit into an end of the roller assembly 304. The end of the roller assembly 304 the internal power source 220 assembly is installed into would likely include at least a portion of the control circuit 204 that controlled power switching, since a short internal power source cable could be used between the internal power source assembly and the control circuit 204. In the preferred embodiment, the internal power source assembly is as illustrated in FIG. 6, and may include the internal power source 220, power source mounts 312A, 312B, and an internal power source electrical cable 512. The press fit of the present application advantageously does not utilize or rely on various fasteners to secure the internal power source assembly that may come loose during expected vibration. Flow proceeds to block 720.

At block 720, the vibration motor 216 and internal power source 220, once seated within the tube 400 using press fit connections, are electrically coupled to a control circuit 204. This is reflected in FIG. 6, as described. Flow proceeds to block 724.

At block 724, the first and second end cap assemblies 534 are mechanically coupled and secured to opposite ends of the tube 400. A first end cap assembly 534 containing the control circuit 204 is shown in FIGS. 5C and 6. The second end cap assembly 534 is not shown, but would be installed on an opposite end of the vibrating roller 100, 150 as the first end cap assembly 534. Flow ends at block 724. At this point, a vibrating roller 100, 150 is fully assembled and ready to use.

Finally, those skilled in the art should appreciate that they can readily use the disclosed conception and specific embodiments as a basis for designing or modifying other structures for carrying out the same purposes of the present invention without departing from the spirit and scope of the invention as defined by the appended claims.

I claim:

1. A vibration device, comprising:

an aluminum tube of cylindrical disposition, comprising an exterior surface and an interior surface;

a foam roller, coupled to and disposed around the exterior surface of the tube and of a similar length as the tube;

a pair of end caps, coupled to each end of one or more of the tube and foam roller;

a power source, disposed within the tube;

a motor, coupled to the interior surface and centrally disposed within the tube, configured to impart vibration to the tube and the foam roller in response to the motor energized by the power source; and a motor mount, directly coupled to the interior surface of the tube, configured to capture the motor within, wherein the motor mount comprises a plurality of external projections configured to engage a plurality of lengthwise grooves of the interior surface, wherein the plurality of lengthwise grooves retain the plurality of external projections and allow the motor mount to slide lengthwise within the tube to facilitate motor mount and motor installation.

2. The vibration device of claim 1, wherein the aluminum tube comprises a single seamless extrusion, comprising:

an outer tube;

an inner tube, concentrically disposed within the outer tube; and three or more radial members, evenly spaced between and coupled to, the outer and inner tubes.

3. The vibration device of claim 2, wherein the outer tube, the inner tube, and three or more radial members are of a same length.

4. The vibration device of claim 1, wherein the foam roller comprises EVA foam directly molded around and to the exterior surface of the aluminum tube.

5. The vibration device of claim 1, further comprising:

a control circuit, electrically coupled to the power source and the motor, configured to selectively switch and regulate the power source to the motor.

6. The vibration device of claim 1, wherein the control circuit is configured to receive one or more control inputs to disable the power source to the motor and select one or more voltages to the motor, wherein each of the one or more voltages are configured to vibrate the motor at a different rate.

7. The vibration device of claim 6, further comprising:

one or more user controls, disposed on one or more of the pair of end caps, configured to provide the one or more control inputs in response to a user activates the one or more user controls.

8. The vibration device of claim 6, further comprising:

a wireless receiver, configured to receive one or more radio frequency commands and in response provide the one or more control inputs that correspond to the one or more radio frequency commands.

9. The vibration device of claim 1, further comprising:

one or more visual indicators, disposed on the pair of end caps, configured to provide an indication of one or more of an on/off state of the motor, a charge state of the power source, and a selected vibration level.

10. The vibration device of claim 1, wherein the power source comprises a battery, wherein an end cap allows access in order to one of remove or replace the battery.

11. A vibrating roller, comprising:

an aluminum tube of cylindrical disposition, comprising:

an outer tube comprising an exterior surface;

an inner tube, concentric with the outer tube, comprising an interior surface, comprising a plurality of evenly spaced lengthwise grooves; and four or more radial members, disposed between and directly coupled to the outer and inner tubes;

a foam roller, molded to and disposed around the exterior surface;

a pair of end caps, each coupled to an end of the aluminum tube;

an internal power source, disposed within the inner tube;

a motor mount, lengthwise centrally disposed within the inner tube and secured to the interior surface by the plurality of lengthwise grooves, wherein the motor mount comprises a plurality of external projections configured to engage the plurality of lengthwise grooves with a friction fit;

a motor, captured within the motor mount and configured to impart vibration to the aluminum tube and the foam roller in response to the motor energized by power source;

one or more user controls, configured to one or more of initiate, stop, and change vibration for the vibrating roller; and a control circuit, coupled to the one or more controls, the power source, and the motor, configured to selectively switch and regulate the power source to the motor in accordance with the one or more user controls.

12. The vibrating roller of claim 11, wherein the outer tube, inner tube, and radial members comprises a single aluminum piece with no seams, wherein no fasteners couple the outer tube, inner tube, and radial members.

13. The vibrating roller of claim 11, further comprising:

one or more visual indicators, disposed on one or more of the pair of end caps, configured to provide one an indication of one or more of a charge state of the power source and a selected vibration level.

14. The vibrating roller of claim 11, wherein the aluminum tube comprises a one-piece extrusion, wherein the inner tube, outer tube, and plurality of radial members are of a common length.

15. The vibrating roller of claim 11, further comprising:

a wireless receiver, configured to receive one or more radio frequency commands and in response provide one or more control inputs that correspond to the one or more radio frequency command to the control circuit.

16. The vibrating roller of claim 11, wherein the one or more user controls are further configured to allow a user to select one of a plurality of vibration intensities, wherein in response to a user selects one of the plurality of vibration intensities, the control circuit is configured to regulate the power source to the motor to vibrate at the one of the plurality of vibration intensities.

17. The vibrating roller of claim 11, wherein the internal power source comprises a rechargeable battery, wherein an end cap allows access to the battery to be one of removed and replaced.

18. A method, comprising:

extruding an aluminum tube;

molding EVA form around an exterior surface of the tube;

press-fitting a motor mount assembly into the tube, the motor mount assembly comprising a motor mount mechanically coupled to a vibration motor within the motor mount, the motor mount assembly being centrally disposed within the tube wherein the motor mount comprises a plurality of external projections configured to engage a plurality of lengthwise grooves of an interior surface of the tube, wherein the lengthwise grooves retain the plurality of external projections and allow the motor mount to slide lengthwise within the tube;

press-fitting an internal power source assembly into the tube, the internal power source assembly comprising a power source mount capturing an internal power source within the power source mount;

electrically coupling the vibration motor and the internal power source to a first end cap comprising a control circuit; and mechanically coupling a second end cap and the first end cap to opposite ends of the tube.

19. The method of claim 18, wherein the aluminum tube comprises an outer tube, an inner tube concentric with the outer tube, and a plurality of radial members coupling the inner tube to the outer tube, wherein the outer tube comprises a greater diameter than the inner tube.

20. The method of claim 19, wherein the EVA foam is molded to an exterior surface of the outer tube, wherein an interior surface of the inner tube comprises a plurality of lengthwise grooves configured to capture a plurality of external projections of the motor mount assembly and the internal power source assembly.

* * * * *